US008732996B2

(12) United States Patent
Groening

(10) Patent No.: US 8,732,996 B2
(45) Date of Patent: May 27, 2014

(54) ADVERTISING DISCS AND LIDS TO RECEIVE ADVERTISING DISCS

(75) Inventor: Dean Groening, O'Connor (AU)

(73) Assignee: Dean Groening (AU)

( * ) Notice: Subject to any disclaimer, the term of this patent is extended or adjusted under 35 U.S.C. 154(b) by 189 days.

(21) Appl. No.: 12/865,648

(22) PCT Filed: Jan. 30, 2009

(86) PCT No.: PCT/AU2009/000089
§ 371 (c)(1),
(2), (4) Date: Sep. 2, 2010

(87) PCT Pub. No.: WO2009/094702
PCT Pub. Date: Aug. 6, 2009

(65) Prior Publication Data

US 2010/0332420 A1 Dec. 30, 2010

(30) Foreign Application Priority Data

Feb. 1, 2008 (AU) ..... 2008900439

(51) Int. Cl.
*G09F 3/00* (2006.01)

(52) U.S. Cl.
USPC ..... 40/307; 40/324

(58) Field of Classification Search
USPC ..... 40/307, 313, 324; 215/230; 220/713; 229/404, 906.1
See application file for complete search history.

(56) References Cited

U.S. PATENT DOCUMENTS

| | | | | |
|---|---|---|---|---|
| 3,421,653 | A | 1/1969 | Whaley | |
| 4,389,802 | A | 6/1983 | McLaren et al. | |
| 5,592,766 | A | 1/1997 | Mygatt | |
| 5,894,952 | A * | 4/1999 | Mendenhall et al. | 220/713 |
| 6,158,155 | A | 12/2000 | Boney | |
| 7,210,577 | B2 * | 5/2007 | Swayne | 206/308.1 |
| 2004/0031797 | A1 | 2/2004 | Farnsworth et al. | |
| 2004/0040194 | A1 * | 3/2004 | Arraut | 40/654.01 |

FOREIGN PATENT DOCUMENTS

| | | |
|---|---|---|
| JP | 54128855 | 9/1979 |
| JP | 5891551 | 6/1983 |
| JP | 3056655 | 2/1999 |
| JP | 2000255618 | 9/2000 |
| JP | 3091176 | 1/2003 |
| JP | 2005084297 | 3/2005 |
| JP | 2005126140 | 5/2005 |
| JP | 2005170436 A | 6/2005 |
| JP | 2005535528 | 11/2005 |
| WO | 2004014776 | 2/2004 |

* cited by examiner

*Primary Examiner* — Joanne Silbermann
(74) *Attorney, Agent, or Firm* — Brooks Kushman P.C.

(57) ABSTRACT

The invention relates to lids for containers, such as disposable beverage containers, which are adapted to receive and hold without adhesive advertising or promotional material. Lids according to the invention include a receptacle with a floor and an inner side wall; wherein the receptacle is capable of receiving the advertising or promotional disc, and the inner side wall of the receptacle is capable of holding the disc in the receptacle. The invention also encompasses an advertising or promotional disc and disposable container lid combination, and a method of providing advertising or promotional media to a consumer.

20 Claims, 5 Drawing Sheets

ADVERTISING DISCS AND LIDS TO RECEIVE ADVERTISING DISCS

TECHNICAL FIELD

The invention concerns advertising. More particularly, it concerns (a) discs for use in advertising (including promotions, brand awareness, marketing, loyalty schemes, and the like, which, in the rest of this specification, for convenience, will be referred to collectively as "advertising") and (b) lids for containers, such as jars, tins, plastic or waxed cardboard "take-away" drink cups—for example, coffee cups—and the like, for receiving such discs.

DEFINITIONS

In this specification, including the claims, "directional" terms (such as "top", "bottom", "side", "underside", "upper", "lower", "above", "upwards", "below", "inwards", "behind", and the like) will be used in the sense that these terms would have with reference to an embodiment of the invention positioned as shown in FIG. 3 of the accompanying drawings.

The term "disc" is intended to encompass a flat circular object which may include printing on one or both sides or faces. A disc may include a single thin sheet, or two or more thin sheets, all of which may have printing on one or both sides or faces, such as a pad or booklet. The term "disc" also encompasses what might more correctly be described as a "tablet", and hence a "disc" need not be circular but might include other shapes, such as oval, hexagonal, pentagonal, octagonal or square, for example. A disc according to the invention may for example be made from plastic or paper products.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgement or any form of suggestion that the prior art forms part of the common general knowledge.

BACKGROUND TO THE INVENTION

Lids of containers, such as jars, tins, cups, and the like, sometimes have product information impressed or glued thereon, which provides information to the consumer. However, such arrangements are limited to a very small array of information media. For example, with respect to advertising material, such media is generally limited to a simple decal. Moreover, difficulties arise where the information printed thereon needs to be individual to a particular shop or outlet, or if it is desirable to attach such media at the point of sale. Further still, it is often desirable that advertising media can be easily removed from the lid, or such media often needs to be of a particular form, such as Tazos™ and the like, which is highly distinctive in nature.

The present inventor has recognised that this situation represents a failure to capitalise on a potentially useful space on container lids.

DISCLOSURE OF THE INVENTION

It is an object of the present invention to provide a mechanism whereby lids may be used to carry advertising or promotional material.

In one aspect, the invention resides in a disc having (or being adapted to have) advertising material printed or otherwise carried on it. All discs have at least two faces. The present inventor now proposes that advertising material may be carried on at least one face of a disc. If the disc has advertising on only one face, another face may carry a layer of a material which enables the disc to be positioned and held on a lid of a receptacle (or on another surface). Such a disc can then be used to display the advertising material on a lid.

The layer of material which enables the disc to be mounted on a lid may be a layer of an adhesive material. In this case, the disc will be securely mounted on the top of a lid (or another surface) by the adhesive. An adhesive material of the type commonly used to attach and readily remove small sheets of paper to a surface, and an adhesive material which can be readily removed from the surface to which it is attached (such material is commonly used to attach replacement credit cards and the like to a sheet of paper when that card is sent through the post), may also be used in this aspect of the invention.

Such a material will be termed a "partially adhesive" material in this specification (including the claims). Double sided adhesive tape may also be used for this purpose.

The periphery or edge disc need not be circular. In fact, the disc may be any shape adapted to fit in the recess of complementary container lid, such as those discussed in greater detail below. The shape and edge of the disc may be in some instances be uniquely shaped to form one part of a unique locking pair for engagement of the disc in a recess in a complementary lid. In this scenario, no adhesive would be required to secure the disc in the lid.

In another aspect, the invention requires the lid structure to be modified so that a disc with no adhesive (or no partially adhesive material, or no other attachment material) may be held in position on the lid. For example, the modification may include the provision of a one or more inwardly facing small protrusions or "nibs", behind which (that is, underneath which) a disc may be positioned, or one or more indentations that can receive one or more protrusions from a complementary disc, or one single circular indentation or recessed edge that can receive a complementary disc. In relation to the former, preferably, the protrusion(s) or nib(s) will extend inwardly a short distance over the top of a recessed region of the lid.

Advertising discs constructed to be retained in place by the nibs, or indentations, on the lid may also be provided with a layer of an adhesive or partially adhesive material, to assist in the retention of the disc in position on the lid, if necessary.

Thus, according to the present invention, an advertising carrier comprises a disc (as defined above), said disc having two or more faces, characterised in that: at least one face of the disc carries, or is adapted to carry, advertising material. In a specific example, one face of the disc carries, or is adapted to carry, advertising material and the other face of the disc is at least partially covered by a layer of a material that enables the disc to be mounted on the lid of a receptacle of the type described above.

According to another aspect, the invention resides in a lid for a container, comprising:

a) a receptacle with a floor and an inner side wall;

wherein the receptacle is capable of receiving an advertising or promotional disc, and the inner side wall of the receptacle is capable of holding the disc in the receptacle.

Preferably, the inner side wall includes at least one protrusion, which is a nib which extends inwardly above the receptacle floor. Alternatively, the protrusion comprises a substantially continuous rim on the sidewall, and the rim extends inwardly above the receptacle floor. The rim can be located at the end of the sidewall distal to the receptacle floor. Alternatively, there can be no distinct protrusion and the angle between the floor and the inner side wall of the receptacle is less than 90 degrees. Preferably, the disc is held in the receptacle of the lid without the use of adhesive. In an alternative arrangement, the inner side wall of the receptacle includes at least one indentation. Thus, a disc received by the receptacle will have at least one protrusion for locking engagement with the at least one indentation. A disc received by the lid of the second aspect is substantially planar with the floor of the receptacle and held in place by the underside of the nib or rim. Again, preferably no adhesive is required.

The indentation may be a recess in the inner side wall or a continuous, or substantially continuous recess, in the inner side wall. The lid can further comprise a recess for disc removal, i.e.: such a recess allowing access to the side edge of a disc held in a lid.

A lid of the invention may include a disc removal recess in the side wall to allow easy access to the side of a disc held in the lid. Thus, a disc held in a lid can easily be removed from the lid by a consumer. The lid may have more than one recesses to facilitate disc removal.

Preferably, a disc for use with the lid of the invention is circular. As mentioned above however, other shapes are envisaged by the invention. The disc may have three or greater sides, and include for example triangles, squares, pentagonals, hexagonals, etc. The disc may be a multilayed disc, such as a booklet and contain advertising or promotional material.

It is especially preferred that the lid of the invention be employed with containers which are beverage containers, such as disposable coffee or hot chocolate cups. Such "take-away" cups generally have a spout through which the beverage is consumed.

In one embodiment, a lid according to the invention includes a plurality (preferably three or more) of inwardly extending nibs; said nibs being so spaced apart that that a respective edge zone of a disc mounted on said lid underlies each nib; whereby said nibs hold said disc in position on said lid.

Typically, as noted above, the region of the lid which is covered by an advertising disc mounted on said lid will be recessed, and said nibs will extend inwardly above said recessed region.

In another aspect the invention resides in an advertising or promotional disc and disposable container lid combination, comprising a lid and an advertising disc (both as described above). A disc being capable of easy removal from the lid by the consumer.

Preferably, the disc is held in the lid without the need for adhesive. The disc may be circular with a weakened central region, through which a straw can be punched. Preferably, the container is a disposable beverage container.

In a further aspect the invention resides in a method of providing advertising or promotional media to a consumer comprising:

a) placing in the outer lid of a container an advertising or promotional disc;
b) placing the lid of step a) onto a container, and
c) delivering the container, its contents, and the lid of step b) to the consumer, wherein the lid and disc are as described as above. Preferably, the container is a disposable beverage container, and the advertising or promotional material is held in the lid without the use of adhesive.

Embodiments of the present invention will now be described, by way of example only. In the following description, reference will be made to the accompanying drawings.

DETAILED DESCRIPTION OF THE ILLUSTRATED EMBODIMENTS

Figure 1A:
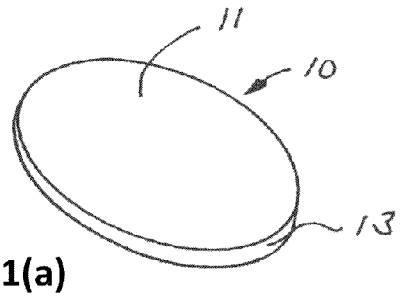
FIG. 1 is a perspective sketch showing two views of an advertising carrier (a disc) which is in accordance with the present invention.
Figure 1B:
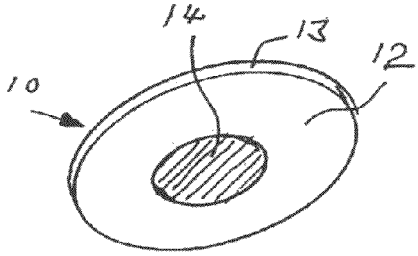

FIG. 1 depicts a disc 10 having a first face 11 and a second face 12. The two faces are separated by a peripheral edge 13. The disc 10 is a circular disc, but a disc which is in accordance with the present invention may have a peripheral edge of any suitable shape.

The face 11 of the disc 10 is adapted to have advertising material printed on it (or mounted on it if the advertising material is—for example—three dimensional).

The disc 10 may be constructed of any suitable material. Thin cardboard will be suitable for some uses of the disc. A disc made from a flexible and resilient plastic material, or a solid disc, will be preferred for other uses of the disc (for example, if the advertising material indicates that a number of discs are to be collected to qualify for a reward from the advertiser, another company or a promoter). Two or more thin discs may be laminated to produce any of these forms of disc. Alternatively, the disc may take the form of a pad or booklet having a number of leaves.

A layer 14 of an adhesive or partially adhesive (as hereinbefore defined) material may be attached to the face 12 (the underside) of the disc 10. This layer 14—which, as noted above, need not be a thin layer, and is optional—enables the disc to be stuck (essentially permanently if the layer 14 is a layer of adhesive; removably adhered if the layer 14 is of a partially adhesive material) to a lid or to another surface.

Figure 2A:
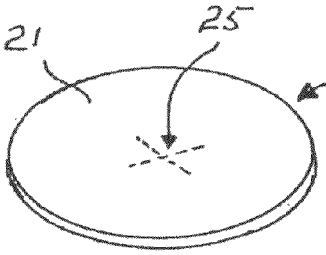
FIG. 2 is a perspective sketch of another form of advertising carrier (also a disc) which is in accordance with the present invention.
Figure 2B:
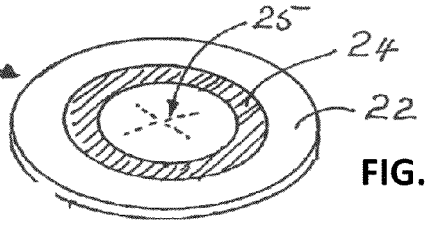

The layer 14 does not have to be applied to the face 12 of the disc 10 in a single location on that face, or applied to the face 12 at all. The layer may comprise two or more "spots" of adhesive or partially adhesive material. Alternatively, the layer may comprise several "bands" of adhesive material, or (as shown in FIG. 2) an annulus of adhesive material may be applied to the face 12. The layer 14 may cover the entire face 12. These alternatives are not exhaustive.

FIG. 2 depicts the topside—FIG. 2(*a*)—and the underneath side—FIG. 2(*b*)—of a disc 20 that is designed for a specific use, namely, as an advertising carrier to be mounted on the lid of a drink container (typically, but not necessarily, a soft drink container). The disc 20 has an upper face 21, on which advertising material may be carried, and a lower (underneath) face 22 onto which an annulus (it need not be this shape) of an adhesive or partially adhesive material 24 has been attached. Alternatively, the disc of FIG. 2 can be used in conjunction with a lid described below, where no adhesive is required. The central portion of the disc 20 has a weakened cross-shaped zone 25. This weakened "cross" zone 25 is broken open along the arms of the cross when a straw (or a similar item) is pressed firmly against the central part of the disc 20. The straw can then penetrate the lid of the soft drink container underneath (that lid may also have a weakened, central, "cross" region), to gain access to the drink in the container.

The lid on which disc of FIG. 2(*a*) is to be mounted may have a central circular section removed (for example, during the die casting process which produces the lid). In this case, instead of a weakened cross-shaped zone 25, the disc 21 may also have a central circular section removed to enable a straw to be pushed through the disc and also through the lid on which the disc has been mounted. Such a central hole in a disc will usually be covered with a material through which an end of a straw may be readily pushed.

FIGS. 3 to 7 illustrate lid constructions in accordance with another aspect of the present invention.

Figure 3:
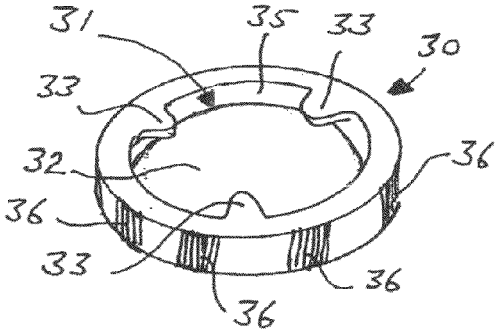
FIG. 3 is a perspective sketch of a lid which is constructed in accordance with an aspect of the present invention.

The lid 30 of FIG. 3 is a typical container lid, such as for use with glass jars, or bottles, or, in fact, any container. The top of the lid 30 has a recessed region 31 that extends downwardly to a "floor" 32. Three nibs 33 (a "nib", in this specification, means an extended region like a small shelf or bracket) extend inwardly from the top of the inside wall 35 that extends upwardly from the floor 32. Corrugated regions 36 are provided on the outside of the lid to facilitate the tightening and loosening of the lid when it is on a container.

A circular advertising disc, which is preferably a flexible and resilient disc, can be inserted underneath the nibs 33. If the advertising disc covers the floor 32, and the thickness of the advertising disc is slightly less than the distance between the underside of a nib and the floor 32, the disc should be held in place in the recess 31 by the nibs 33. However, if the disc is a thin, flexible disc, or if desired, a layer of an adhesive material or of a partially adhesive material may be applied to a region (or regions) of the underside of the disc, to remove any possibility that the disc may slip out of the recess 31.

Figure 4:
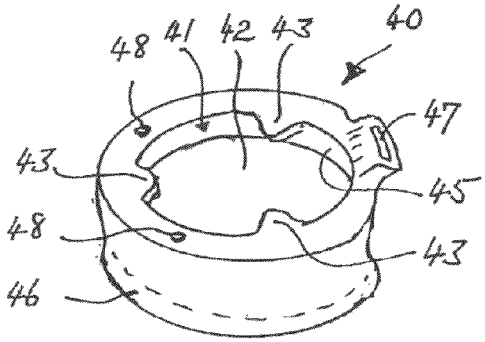
FIG. 4 is a partly schematic sketch of a lid of a disposable drink cup, in accordance with an aspect of the present invention.

FIG. 4 shows, partly schematically, how the present invention may be used in the lid of a drink container of the type used to supply "take-away" coffee. The lid 40 has a similar construction to the lid 30 shown in FIG. 3, with a recessed region 41, nibs 43 and a "floor" 42. However, a) the lid 40 is made from a plastic material with a known moulded part lower region 46, which enables the lid to be readily mounted or pressed onto the top rim of a drink container;
b) an elongate (horizontal) drinking aperture 47 is also provided, in a raised moulded part of the top surface of the lid, to enable the contents of the drink container to be drunk without the need to remove the lid from the container; and
c) air holes 48 are provided to enable air to replace the liquid that is drunk from the container through the drinking aperture 47.

Figure 5:
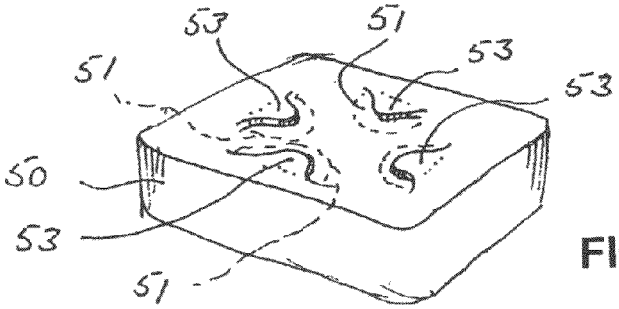
FIG. 5 shows another form of lid, constructed in accordance with an aspect of the present invention.
Figure 6D:
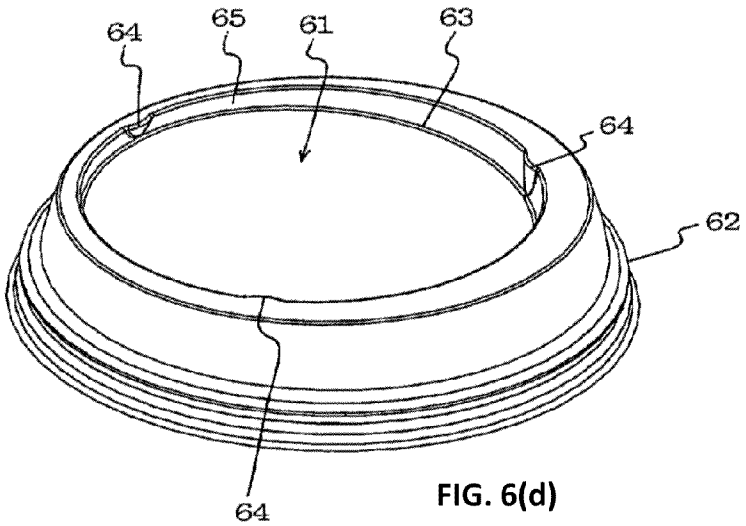
FIG. 6 shows a lid for a "take-away" drink cup, constructed in accordance with a preferred embodiment of the present invention.
Figure 6A:
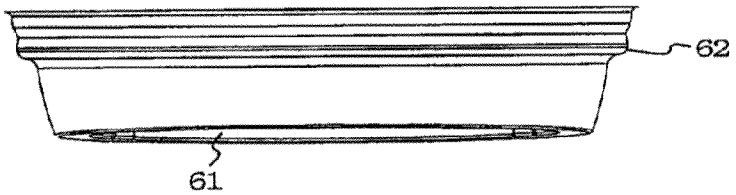
Figure 6B:
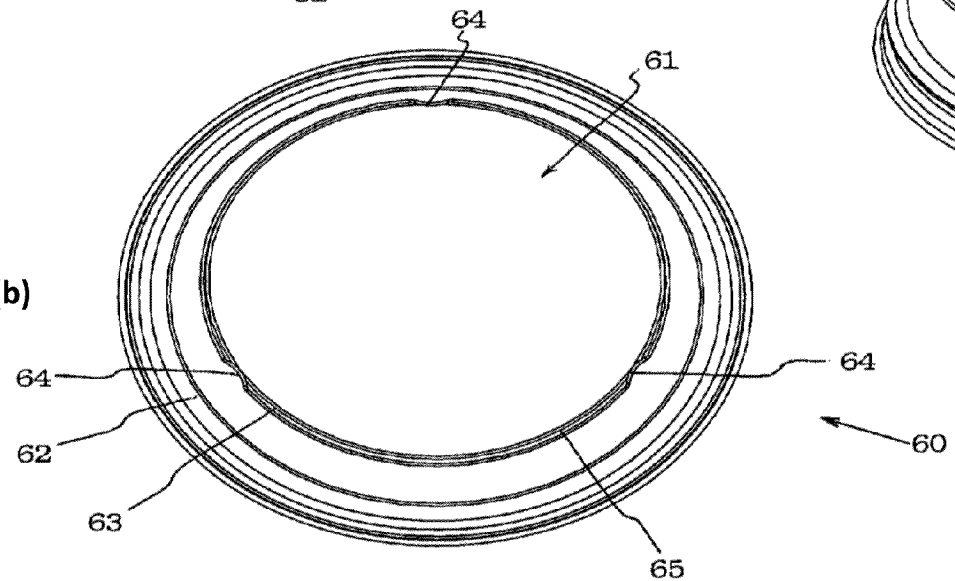
Figure 6C:
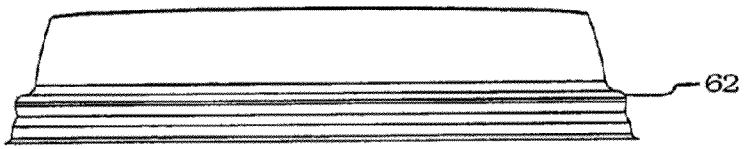

FIG. 5 depicts a container lid 50 which has a moulded construction comprising four nibs 53 formed integrally with, and extending from, the uppermost surface of the lid 50. A respective recessed region 51 is formed beneath each nib 53. The edges of an advertising disc may be inserted underneath each nib 53. The nibs 53 have sufficient resiliency to hold the advertising disc in position. However, as noted previously, an advertising disc may be held on the lid 50 not only by the nibs 53 but also by a layer (or layers) of an adhesive or partially adhesive material on the underside face of the disc, if required.

The nibs 43 and 53 may have any suitable shape. They may be flexible and resilient, or (if they are to retain a flexible and resilient disc) they may be inflexible.

Figures 7A, 7B, 7C, 7D:
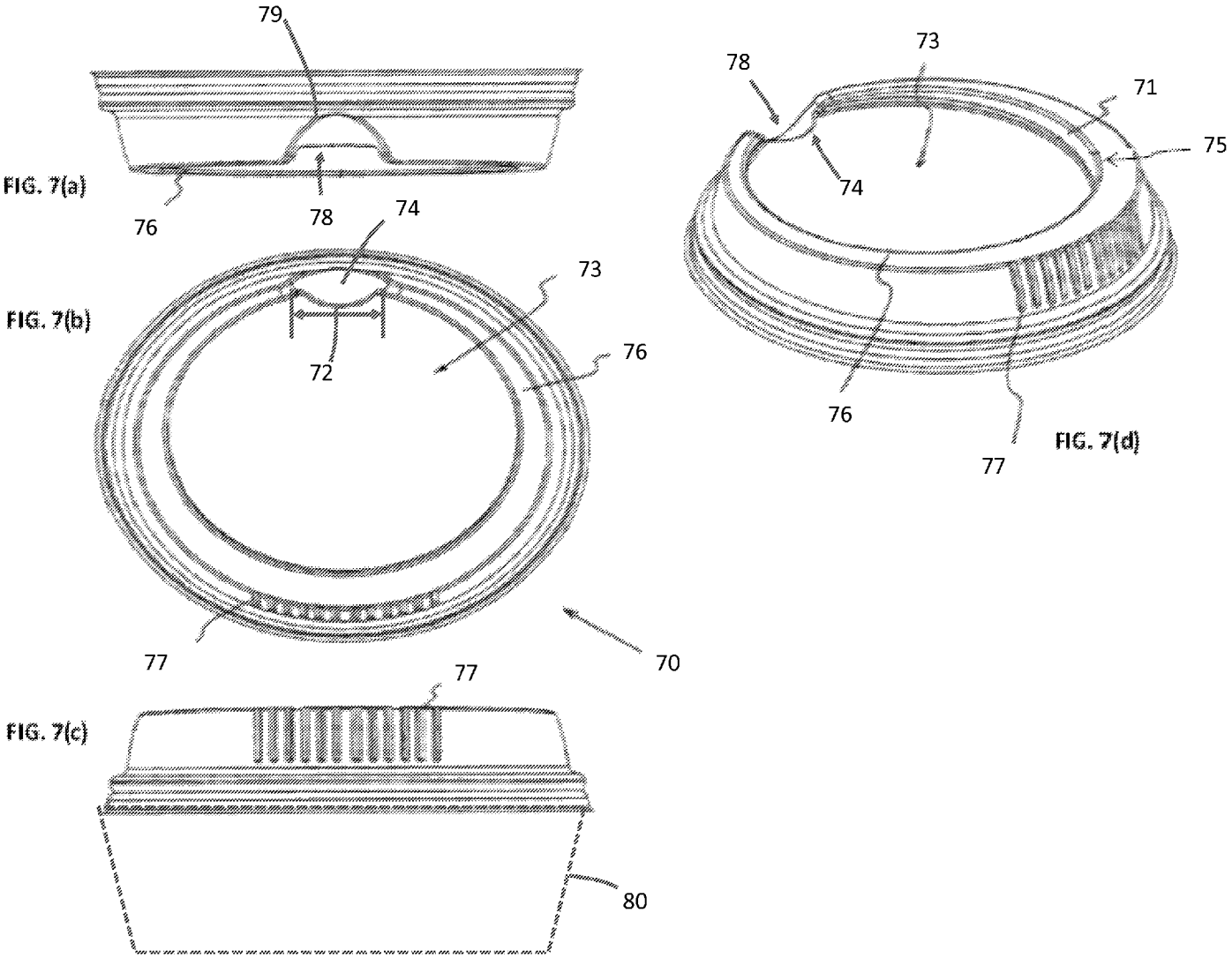
FIG. 7 shows a lid for a "take-away" drink cup, constructed in accordance with a preferred embodiment of the present invention.

The lids depicted in FIGS. 6 and 7 are particularly well suited for use on the top of takeaway or disposable beverage containers, such as takeaway coffee and chocolate cups. The lids of FIGS. 6 and 7 are preferably constructed from moulded plastic, or the like.

With reference to FIG. 6, FIG. 6(*b*) depicts a view from above the container lid 60, whereas FIGS. (a) and (c) are side views of the same lid. FIG. (d) is a perspective view of the lid. Rim 62 of lid 60 is intended to be pressed into locking engagement with the top rim of a beverage container. The lid 60 includes a recessed region 61 that extends downwardly to a floor 63. Three nibs 64 (a "nib", in this specification, is as defined above) extend inwardly from the top of the inside wall 65 that extends upwardly from the floor 63. Corrugated regions (not shown) may be provided on the outside of the lid to facilitate the attachment of the lid to the beverage container.

An advertising disc, which is preferably a flexible and resilient disc, can be inserted underneath the nibs 64. If the advertising disc covers the floor 63, and the thickness of the advertising disc is slightly less than the distance between the underside of a nib and the floor 63, the disc should be held in place in the recess 61 by the nibs 64. However, if the disc is a thin, flexible disc, or if desired, a layer of an adhesive material or of a partially adhesive material may be applied to a region (or regions) of the underside of the disc, to remove any possibility that the disc may slip out of the recess 61.

The advertising disc held in place in lid 60 can be removed from the lid by the consumer inserting a finger nail between the edge of the disc and the inside wall 65 of the lid 60. Alternatively, the lid can be distorted, or pressure applied to the bottom of the floor 63, to force the disc from the recessed region 61.

The lid 70 of FIG. 7 has a similar construction to the lid 60 shown in FIG. 6, with a recessed region 71, floor 73, inner side wall 75 and disc removal recess 78, also referred to as a gap portion 78. However, lid 70 does not include three separate nibs to hold a disc, but rather employs a substantially continuous rim 76 of smaller diameter than the diameter of the floor 73. Thus, a disc positioned in the recessed region 71 and of a size similar to that of the floor will be held in place by the inwardly sloping inner side wall 75. In other words, the inner wall is essentially a single substantially continuous "nib" for retaining a disc, only broken by the opening 72 extending below the floor 73, defined by the disc removal recess 78. The inner side wall is thus 90 degrees or less to floor 73. Corrugated regions 77 are provided on the outside of the lid to facilitate the attachment of the lid to the beverage container.

In an alternative embodiment not shown, the lid may include one or more recesses around the perimeter of inner side wall of the recessed region for engagement with one or more protrusions on an advertising disc.

The lid 70 of FIG. 7 includes a disc removal recess 78. The disc removal recess 78 or gap portion 78, in conjunction with an indentation 74 provided within the floor 73 forms a cavity 79 below the floor 73 and exposes a peripheral edge of a disc held in place in lid 70. In use, a disc held in place in lid 70 can easily be removed from the lid as the side of the disc can easily be accessed by the consumer. The lid may have one or more recesses to facilitate disc removal.

Figure 8B:
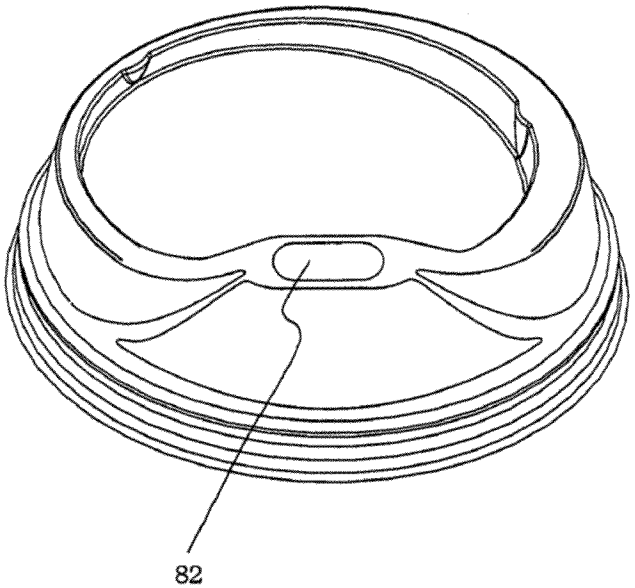
FIG. 8 shows a lid for a "take-away" drink cup, constructed in accordance with a preferred embodiment of the present invention and including a drinking spout.
Figure 8A:
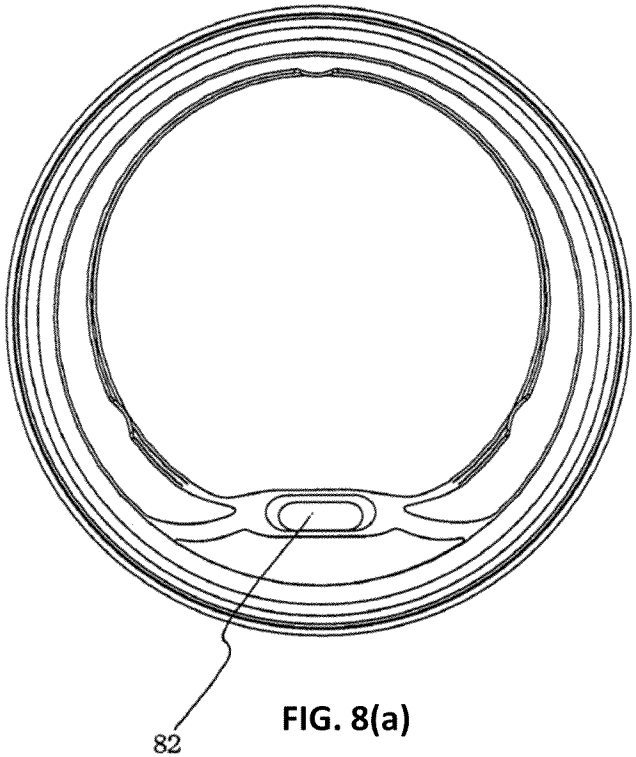
Figure 9B:
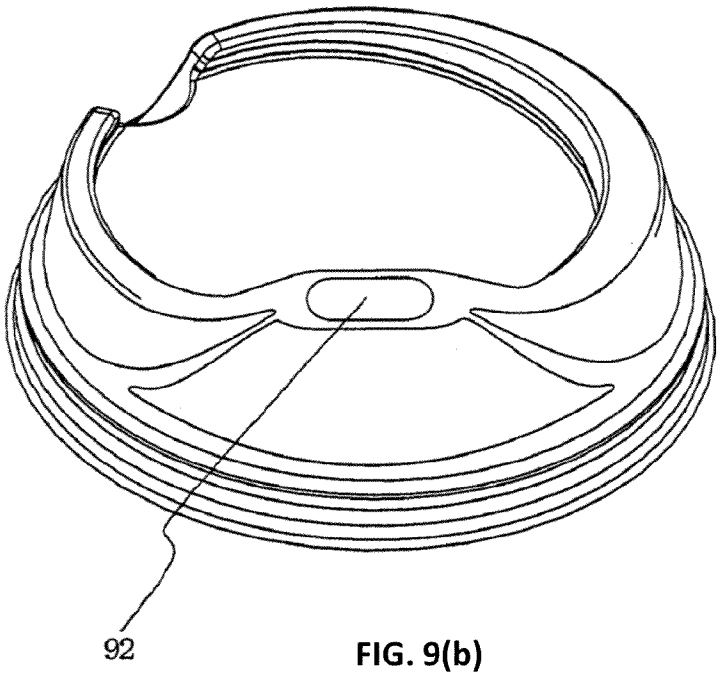
FIG. 9 shows a lid for a "take-away" drink cup, constructed in accordance with a preferred embodiment of the present invention and including a drinking spout.
Figure 9A:
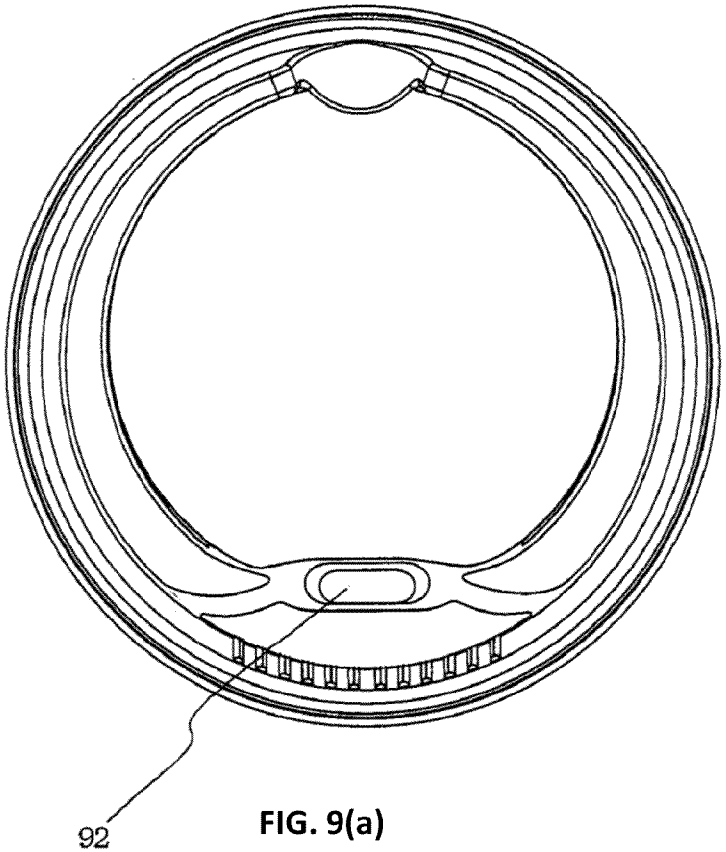

FIG. 8 shows a lid that is very similar to the lid of FIG. 6, as described above, except that it includes a drinking spout 82. FIG. 9 shows a lid that is very similar to the lid of FIG. 7, as described above, except that it includes a drinking spout.

Engineers and advertising executives will appreciate that examples only of the present invention have been illustrated in the accompanying drawings, and described above. Variations of, and modifications to, the illustrated embodiments (in addition to the alternative constructions already noted above) may be made without departing from the present inventive concept, as defined by the claims.

The claims defining the invention are as follows:

1. A lid for a container, comprising:

a lid having a floor with an upper floor surface, a surrounding circumferential rim having a downwardly extending portion for cooperation with a container and an upwardly extending portion which defines an inner side wall surrounding and extending above the upper floor surface, wherein the upper floor surface and the inner side wall defines a space for receiving a disc carrying at least one of advertising and promotional material, the disc having an upper and lower surface and peripheral edge, the lower surface of a received disc facing the upper floor surface, wherein the inner side wall is capable of retaining a received disc in the space, wherein the circumferential rim defines a gap portion which provides an opening in the inner side wall extending below the upper floor surface, the gap portion exposes a portion of the peripheral edge of a received disc; the floor is provided with an indentation which forms a cavity below the upper floor surface, the indentation is located adjacent the gap portion, the indentation exposes a portion of the lower surface of a received disc; wherein the combination of the gap portion and the indentation facilitates ease of removal of a received disc from the space by allowing a user to physically contact the exposed portion of the peripheral edge and lower surface of the received disc.

2. The lid of claim 1, wherein the inner side wall comprises at least one protrusion.

3. The lid of claim 2, wherein the protrusion is a nib which extends from the inner side wall inwardly above the upper floor surface.

4. The lid of claim 2, wherein the protrusion is a continuous protrusion which extends from the inner side wall inwardly above the upper floor surface and along substantially an entire length of the inner side wall.

5. The lid of claim 4, wherein the protrusion is located at an upper end of the inner side wall distal from the upper floor surface.

6. The lid of claim 1, wherein an angle between the upper floor surface and the inner side wall is less than or equal to 90 degrees.

7. The lid of claim 1, wherein the inner side wall defines one recess arranged to receive a portion of the peripheral edge of a received disc.

8. The lid of claim 7, wherein the recess is a continuous recess extending along substantially the entire length of the inner side wall.

9. The lid of claim 1, wherein the circumferential rim comprises a drinking spout portion.

10. The lid of claim 1, wherein the container is a disposable drinking container.

11. An advertising disc and disposable container lid combination, comprising:

an advertising disc having an upper and lower surface and peripheral edge, wherein the upper surface carries at least one of advertising and promotional material;

a lid having a floor with an upper floor surface, a surrounding circumferential rim having a downwardly extending portion for cooperation with a container and an upwardly extending portion which defines an inner side wall surrounding and extending above the upper floor surface, wherein the upper floor surface and the inner side wall defines a space for receiving the disc, wherein the inner side wall is capable of retaining the received disc in the space, wherein the circumferential rim defines a gap portion which provides an opening in the inner side wall and extends below the upper floor surface, the gap portion exposes a portion of the peripheral edge of the received disc, the floor defines an indentation which forms a cavity below the upper floor surface, the indentation is located adjacent the gap portion, the indentation exposes a portion of the lower surface of the received disc, wherein the combination of the gap portion and the indentation facilitates ease of removal of the received disc from the space by allowing a user to physically contact the exposed portion of the peripheral edge and lower surface of the received disc.

12. The combination of claim 11, wherein the inner side wall comprises one protrusion.

13. The combination of claim 12, wherein the protrusion is a nib which extends from the inner side wall inwardly above the upper floor surface.

14. The combination of claim 12, wherein the protrusion is a continuous protrusion which extends from the inner side wall inwardly above the upper floor surface and along substantially an entire length of the inner side wall.

15. The combination of claim 14, wherein the protrusion is located at an upper end of the inner side wall distal to the upper floor surface.

16. The combination of claim 11, wherein an angle between the upper floor surface and the inner side wall is less than or equal to 90 degrees.

17. The combination of claim 11, wherein the inner side wall defines one recess arranged to receive a portion of the peripheral edge of a received disc.

18. The combination of claim 17, wherein the recess is a continuous recess extending along substantially the entire length of the inner side wall.

19. The combination of claim 11, wherein the circumferential rim comprises a drinking spout portion.

20. The combination of claim 11, wherein the disc has a weakened central region.

* * * * *